US007238905B2

(12) United States Patent
Oh

(10) Patent No.: US 7,238,905 B2
(45) Date of Patent: Jul. 3, 2007

(54) SINGLE BUTTON SIX-WAY SUNROOF SWITCH

(75) Inventor: Se Wook Oh, Hwaseong-si (KR)

(73) Assignee: Hyundai Motor Company, Seocho-Ku, Seoul (KR)

( * ) Notice: Subject to any disclaimer, the term of this patent is extended or adjusted under 35 U.S.C. 154(b) by 9 days.

(21) Appl. No.: 11/302,398

(22) Filed: Dec. 12, 2005

(65) Prior Publication Data

US 2006/0131140 A1 Jun. 22, 2006

(30) Foreign Application Priority Data

Dec. 22, 2004 (KR) ..... 10-2004-0109976

(51) Int. Cl.
*H01H 9/00* (2006.01)

(52) U.S. Cl. ..... 200/339; 200/313

(58) Field of Classification Search ..... 200/313–315, 200/317–318.2, 329–332, 339, 553, 5 R, 200/16 R, 18, 561, 50.32–35
See application file for complete search history.

(56) References Cited

U.S. PATENT DOCUMENTS 4,520,240 A * 5/1985 Swindler ..... 200/5 R
5,721,405 A * 2/1998 Hamada ..... 200/16 R
5,920,042 A * 7/1999 Gotoh ..... 200/5 R
6,409,261 B1 * 6/2002 Lindinger et al. ..... 200/4
2004/0222075 A1 * 11/2004 Peterson ..... 200/329

* cited by examiner

*Primary Examiner*—K. Lee
*Assistant Examiner*—M. Fishman
(74) *Attorney, Agent, or Firm*—Morgan Lewis & Bockius LLP

(57) ABSTRACT

A single button six-way sunroof switch includes a case; a knob base which has a coupling hole, hooks, and a hinge hole; a knob with coupling grooves, wherein the hooks of the knob base are engaged with the coupling grooves; a light emitting rod having a latching jaw, which is latched with the upper end of the knob base around the coupling hole; a lever integrally formed with the light emitting rod; a slider which has a panel with a through-hole, support legs extended from corners of the panel, and a hinge pin; a contact having a body part coupled to the lever, which passes through the through-hole of the slider, and contact-point legs extended from the body part in four directions; and a Printed Circuit Board having tact switches to be pushed by the lever and a plurality of contact points contacted by the contact-point legs.

12 Claims, 13 Drawing Sheets

SINGLE BUTTON SIX-WAY SUNROOF SWITCH

CROSS REFERENCE TO RELATED APPLICATION

This application is based on, and claims priority to Korean Patent Application No. 10-2004-0109976, filed on Dec. 22, 2004, the disclosure of which is hereby incorporated by reference.

BACKGROUND OF THE INVENTION

1. Field of the Invention

The present invention relates to a sunroof switch, and more particularly to a single button six-way sunroof switch that can open and close a sunroof in six ways (full-open, full-close, tilt-up, tilt-down, partial-open and partial-close) with one-touch operation using a single button, thereby permitting a driver to freely control degree of opening of a sunroof as he/she desires.

2. Description of the Related Art

Generally, a conventional sunroof switch for opening and closing a sunroof is installed near the sunroof on the ceiling of the passenger compartment of a vehicle and an operation element is provided to the sunroof switch to allow a driver to control degree of opening of a sunroof in four ways (open, close, tilt-up and tilt-down) or six ways (full-open, full-close, tilt-up, tilt-down, partial-open and partial-close).

SUMMARY OF THE INVENTION

Embodiments of the present invention provide a sunroof switch including: a case having a hollowed inner space and openings at an upper and a lower end portion; a knob base having a coupling hole penetrated in a vertical direction, projected hooks on both side surfaces and a hinge hole at a lower end portion thereof; a knob with coupling grooves on both side surfaces thereof wherein the hooks of the knob base are engaged with the coupling grooves; a light emitting rod having a latching jaw at an upper end portion thereof wherein the latching jaw is latched with the upper end of the knob base around the coupling hole; a lever integrally formed with the light emitting rod by being extended from both sides and a lower end of the light emitting rod; a slider having a panel with a through-hole penetrated in the vertical direction and formed at the center portion of the panel, support legs extended from corners of the panel and integrally formed with the panel, and a hinge pin formed on an upper end portion; a contact having a body part coupled to a lower end portion of the lever which passes through the through-hole of the slider and contact-point legs attached to the body part in four directions; a PCB having an upper surface on which tact switches to be pushed by the lever are arranged on both side edge portions and a plurality of contact points with which the contact-point legs are brought into contact are arranged; and a cover for covering the opened lower end portion of the case.

In accordance with the preferred embodiment of the present invention, the case further has a guide with a cross guide hole at an upper end portion thereof.

A guide pin to be engaged with the cross guide hole is formed at the opposite position of the hinge hole, projecting from a surface of the knob base.

The case further has holders shaped with right angles on its inner surfaces.

In accordance with the preferred embodiment of the present invention, the slider further has support grooves on both sides, into which sets of springs and rods are inserted, which are supported by the respective support grooves, and the front ends of the rods are received and supported by the holders by elastic forces of the springs.

In accordance with the preferred embodiment of the present invention, the case further has slide slots at lower portions of both sides of the case, which limit movement of the slider. A slide pin inserted into each slide slot is integrally formed with each contact-point leg by being projected on the outer surface of each contact-point leg.

In accordance with the preferred embodiment of the present invention, coupling projections are integrally formed with the lever by being projected from both sides of the lever in the middle portion of the lower part thereof, and the body part of the contact has coupling holes on both side surfaces, with which the coupling projections are engaged.

In accordance with the preferred embodiment of the present invention, the lower part of the lever has two ends, which extend to reach the tact switches and have push pads on the bottom, which selectively push the tact switches.

In accordance with the preferred embodiment of the present invention, two of the contact-point legs are first contact-point legs provided for partial-open and partial-close operations of the sunroof, and the other two of the contact-point legs are second contact-point legs provided for full-open and full-close operations of the sunroof.

In accordance with the preferred embodiment of the present invention, on the upper surface of the PCB, a negative polarity terminal is arranged on one side, tilt-up/tilt-down contact points with which the tact switches will be brought into contact are arranged in the middle portion, first step contact points are arranged between the negative polarity terminal and the tilt-up/tilt-down contact points where the first contact-point legs among the contact-point legs reach the first step contact points, and second step contact points are arranged at the side opposite the negative polarity terminal. An LED is also mounted on the center portion of the PCB.

DETAILED DESCRIPTION OF THE PREFERRED EMBODIMENTS

Hereinafter, the present invention will be described in detail by describing preferred embodiments of the present invention with reference to the accompanying drawings.

Figure 1:
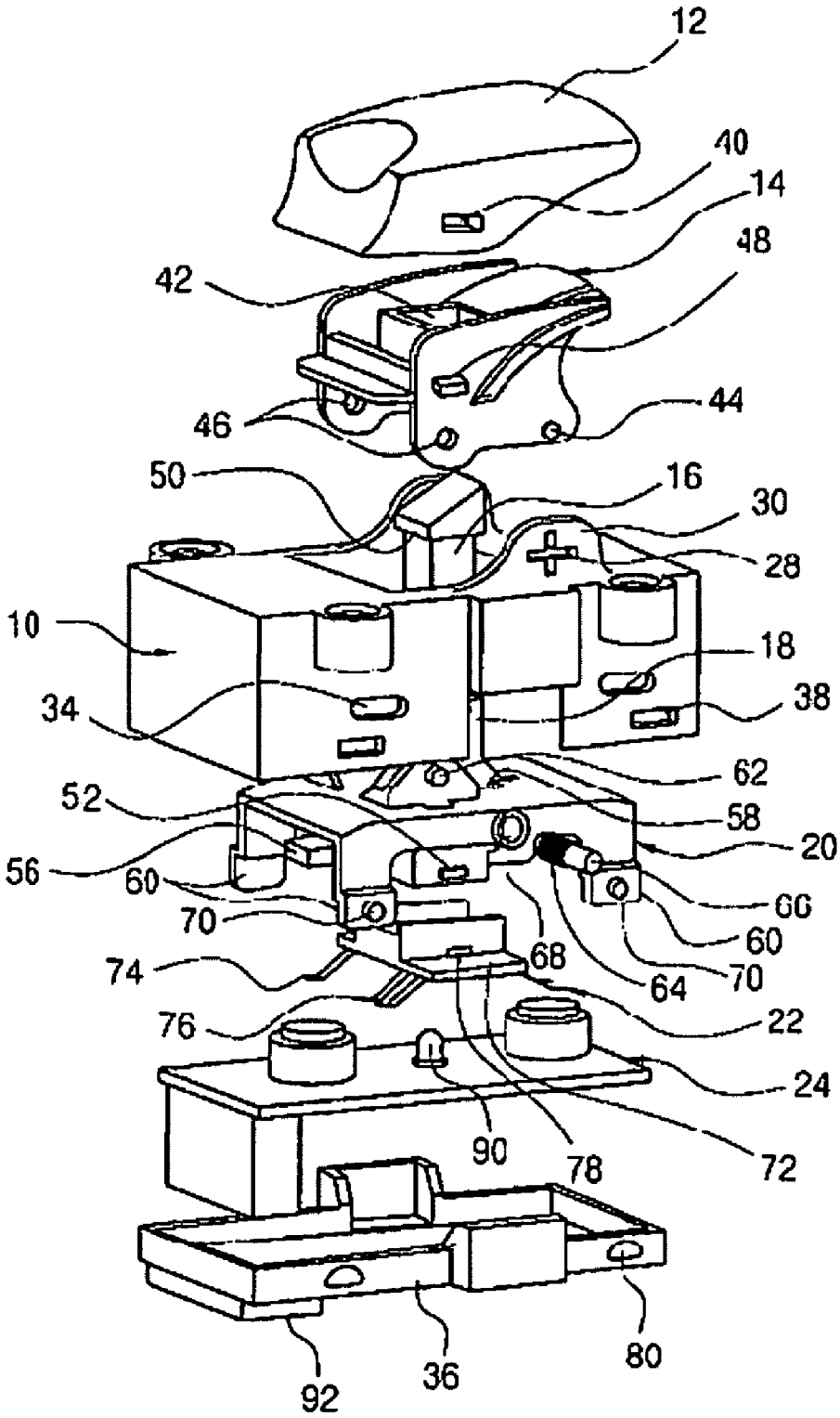
FIG. 1 is an exploded perspective view of a single button six-way sunroof switch in accordance with the present invention.

Referring to FIG. 1, a single button six-way sunroof switch in accordance with the present invention includes a case 10, a knob 12 and a knob base 14 which are installed on the case 10, a light emitting rod 16 and a lever 18 which are installed inside the case 10, a slider 20, a contact 22 and a PCB 24 with contact points, which are installed under the lever 18, and a cover 36 covering a lower part of the case 10 when all the parts in FIG. 1 are assembled.

Each part of the single button six-way sunroof switch will be described below in detail.

The case 10 has openings at a center portion of an upper part and at the whole portion of a lower part. The case 10 is a hollowed rectangular parallelepiped and houses components of the switch.

Guide plates 30 are perpendicularly provided on the case 10 at both side edges thereof and the guide plates 30 and the case 10 are integrally formed to be a single body. The guide plates 30 have cross holes 28.

Figure 6A:
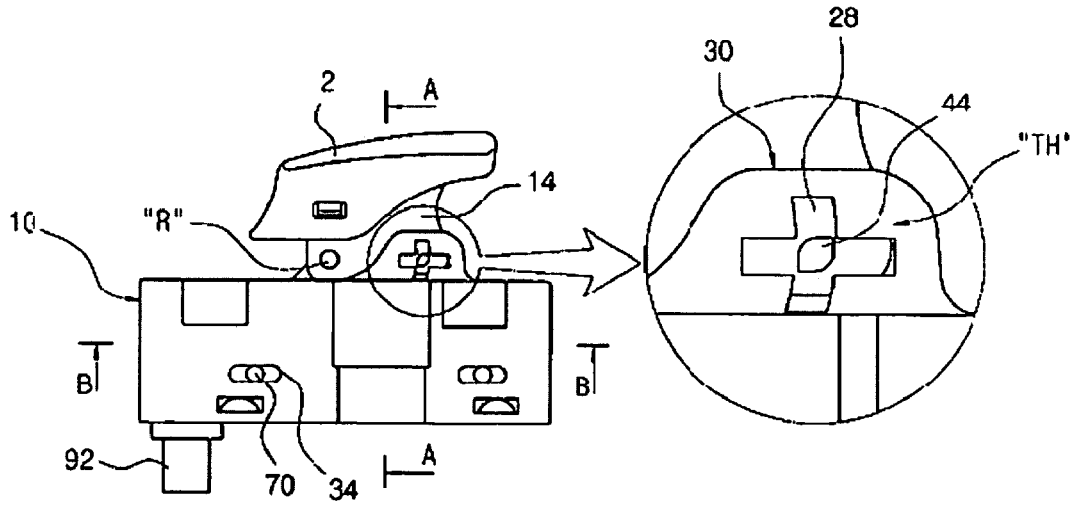
FIG. 6A is a side view of a single button six-way sunroof switch in accordance with the present invention.
Figure 6B:
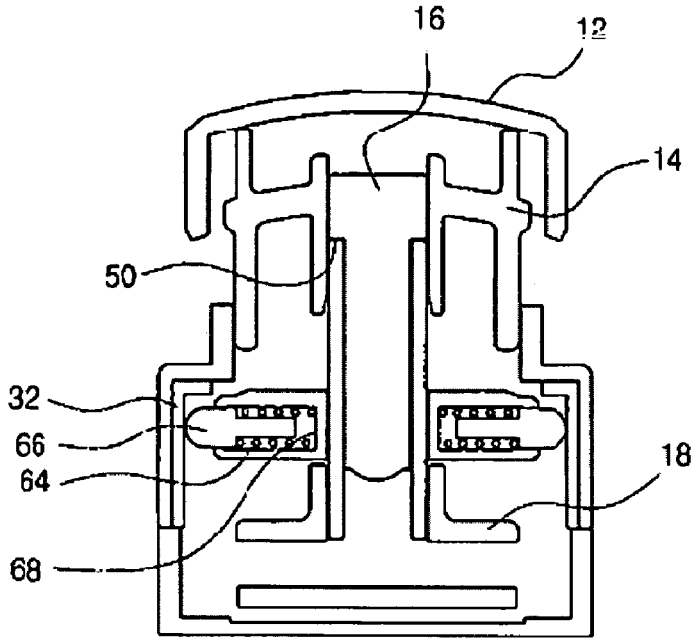
FIG. 6B is a cross-sectional view of a single button six-way sunroof switch in accordance with the present invention, taken along line A—A in FIG. 6A.
Figure 6C:
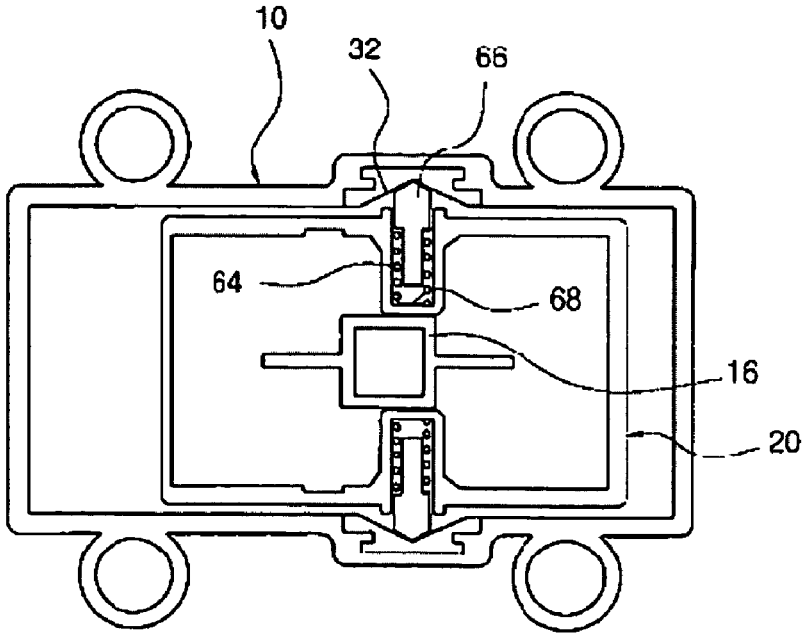
FIG. 6C is a cross-sectional view of a single button six-way sunroof switch in accordance with the present invention, taken along line B—B in FIG. 6A.

Additionally referring to FIGS. 6B and 6C, the case 10 has holders 32, formed as right angles, on both inner walls. The case 10 further has slide slots 34 formed to penetrate side walls of the case 10 at a lower portion thereof and extend horizontally. Coupling grooves 38 are formed on outer side surfaces of the case 10 below the slide slots 34. The coupling grooves 38 are used to couple with a cover described below.

The knob 12 substantially serves as an operation handle and has an engraved radiation mark on the upper surface thereof, where the mark indicates the directions of opening and closing of a sunroof to allow a driver to visually identify the direction of operation of a sunroof and its location. The knob 12 further has penetrated coupling holes 40 on both sides.

The knob base 14 to be coupled with the knob 12 has a coupling hole 42 penetrated in the vertical direction. On both side surfaces of the knob base 14, guide pins 44 to be engaged with the cross holes 28 are integrally formed with the knob base 14 at rear lower end portions and hinge holes 46 are formed at front lower end portions.

Further on both side surfaces of the knob base 14, projected hooks 48 to be engaged with coupling holes 40 of the knob 12 are integrally formed with the knob base 14 above the hinge holes 36.

Figure 2A:
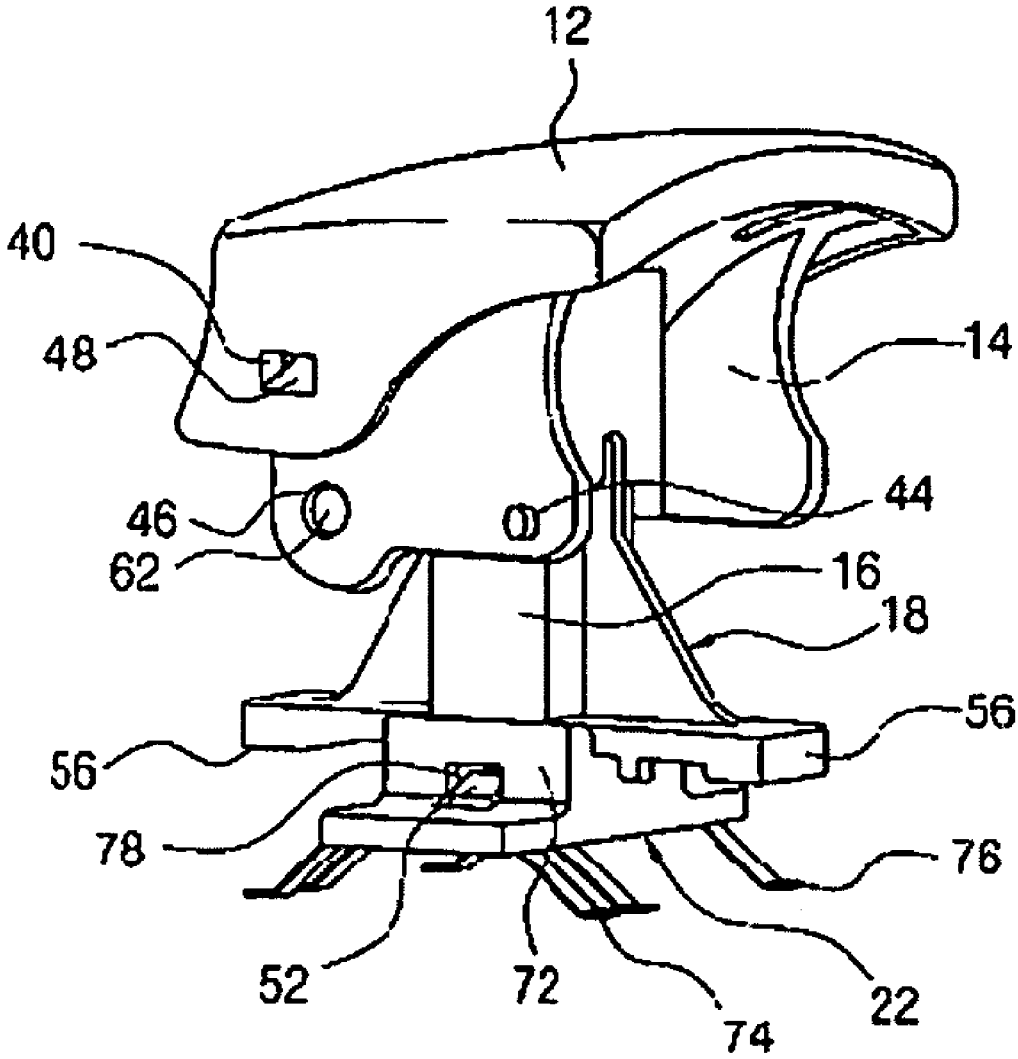
FIG. 2A and FIG. 2B are perspective views showing the procedure of assembling parts constituting an upper portion of a single button six-way sunroof switch in accordance with the present invention.
Figure 2B:
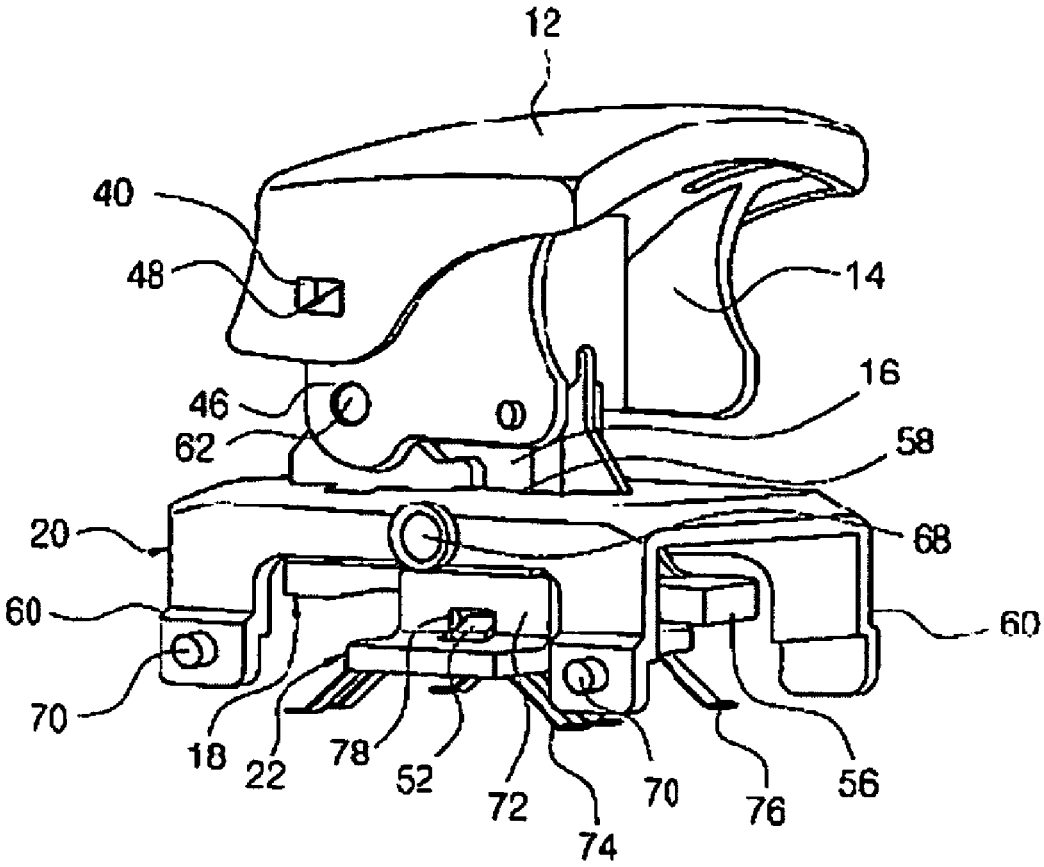

Referring to FIG. 2A and FIG. 2B, the knob 12 and the knob base 14 are coupled such that the hooks 48 of the knob base 14 are inserted into the coupling holes 40 of the knob 12.

Here, the light emitting rod 16 is inserted into the coupling hole 42 of the knob base 14 and has a latch jaw 50 at an upper end portion thereof where the latch jaw 50 is integrally formed with the light emitting rod 16 to be a single body. The light emitting rod 16 and the knob base 14 are coupled such that the latch jaw 50 is latched with the edge of the penetrated coupling hole 42 of the knob base 14.

Figure 3A:
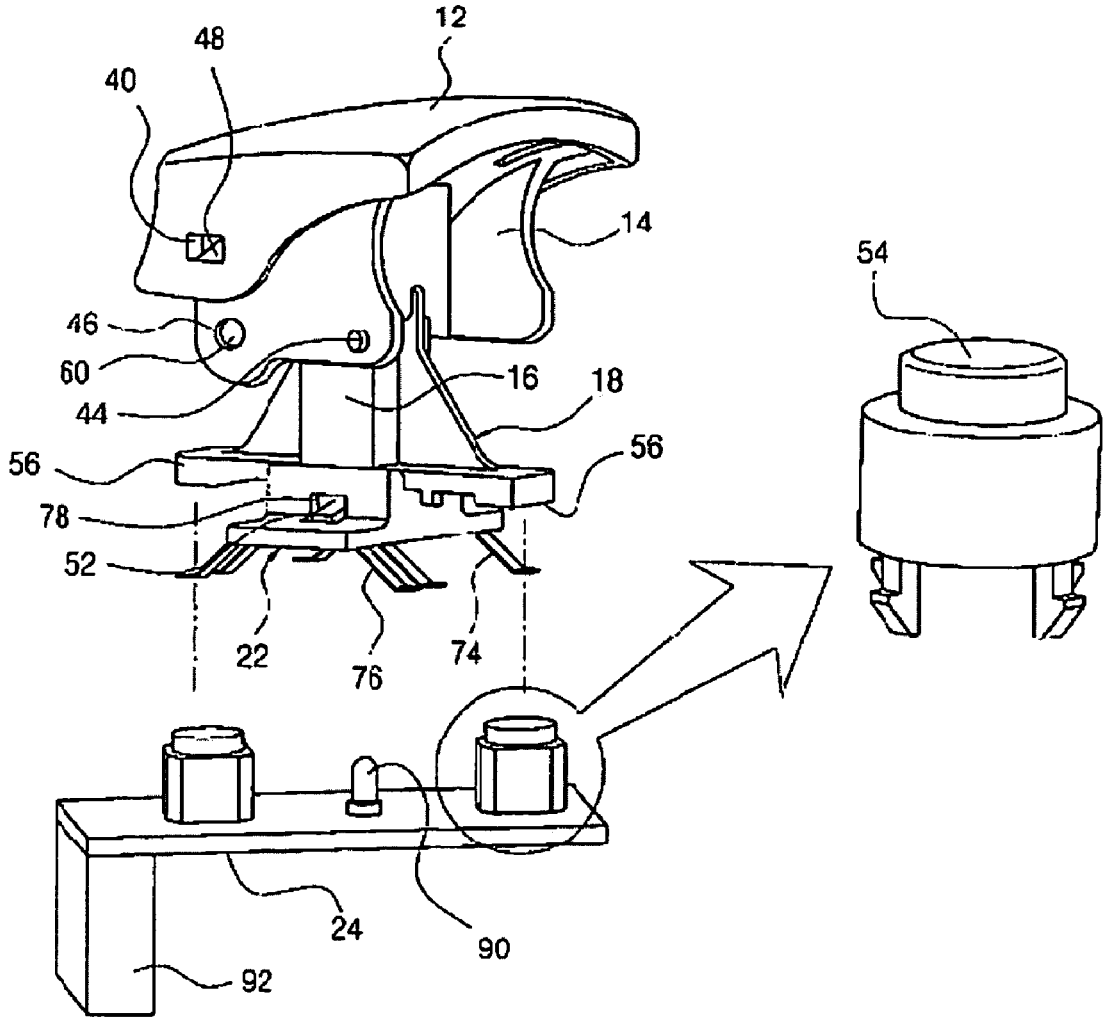
FIG. 3A and FIG. 3B are perspective views showing the procedure of assembling parts constituting a lower portion of a single button six-way sunroof switch in accordance with the present invention.
Figure 3B:
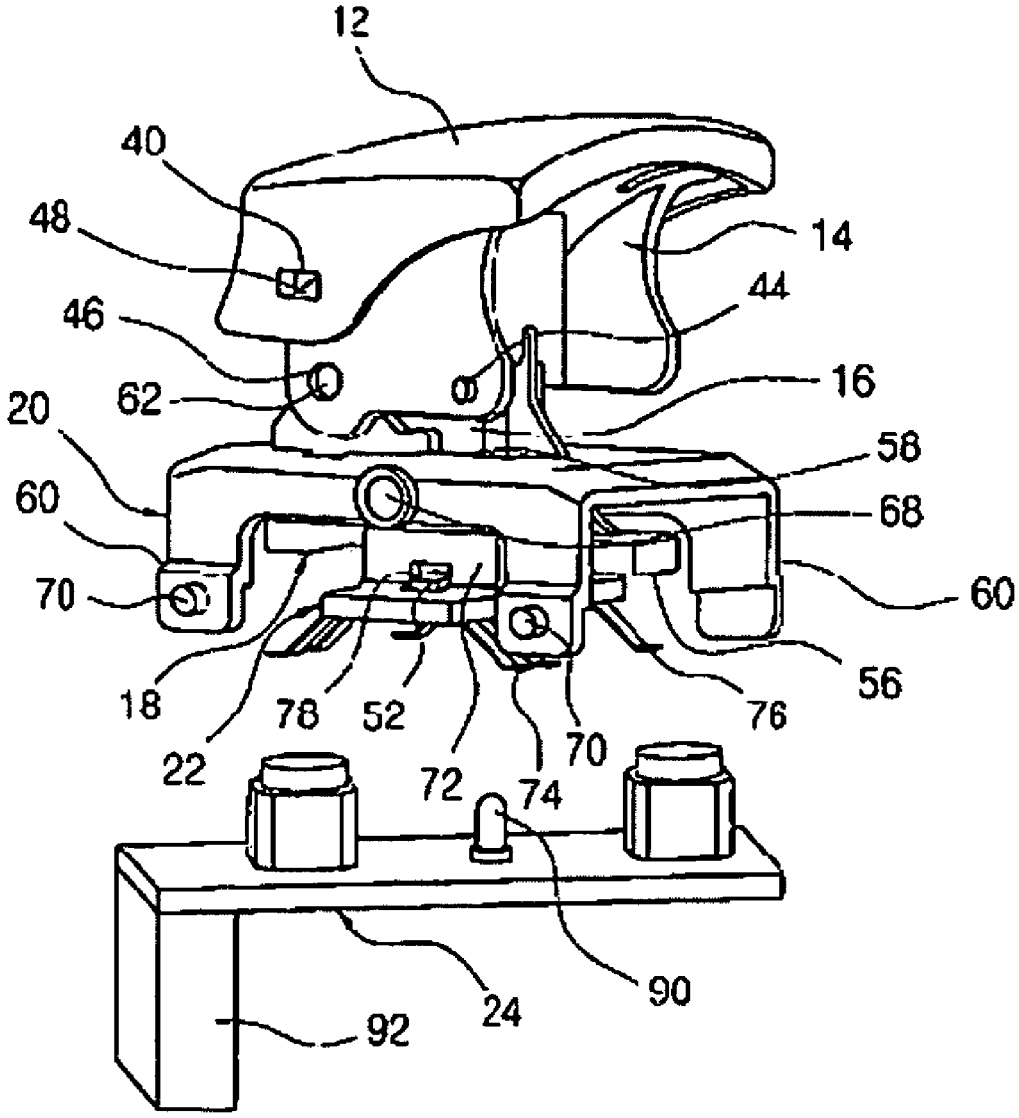

Further, the lever 18 is integrally formed with the light emitting rod 16 to be a single body, and extends along the side and the lower end of the light emitting rod 16. The lever 18 and the light emitting rod 16 serve as a fulcrum for a seesaw motion together. The lever 18 has coupling projections 52 in the lower middle portion of the both side surfaces thereof. Referring to FIG. 3A, both lower end portions of the lever 18 extend to contact with tact switches 54 formed on the PCB 24 and have respective push pads 56 on the bottom thereof where the push pads 56 alternatively push the corresponding tact switches 54.

The slider 20 has a panel with a through-hole 58 formed at the center portion to penetrate the panel. The slider 20 has support legs 60 integrally formed with the panel and extending from each corner of the panel. Hinge pins 62 are formed around the outer circumferential edge of the through-hole 58 so as to be engaged with the hinge holes 46 provided to the knob base 14.

The slider 20 and the knob base 14 are coupled such that the hinge pins 62 are inserted into the hinge holes 46 of the knob base 14. When the slider 20 and the knob base 14 are coupled, the middle portion of the light emitting rod 16 i.e. the boundary portion between the light emitting rod 16 and the lever, 18 is inserted into the through-hole 58.

Referring again to FIG. 6B, in the middle portion of the both side surfaces of the slider 20, support grooves 68 are formed so that sets of springs 64 and rods 66 are inserted there into. The front end of each rod 66 is received in and supported by each holder 32 provided inside the case 10 by an elastic force of each spring 64.

Referring to FIG. 2B, slide pins 70 are integrally formed on the outer surfaces of the respective support legs 60 to be inserted into the slide slots 34 provided to the case 10.

Figure 4A:
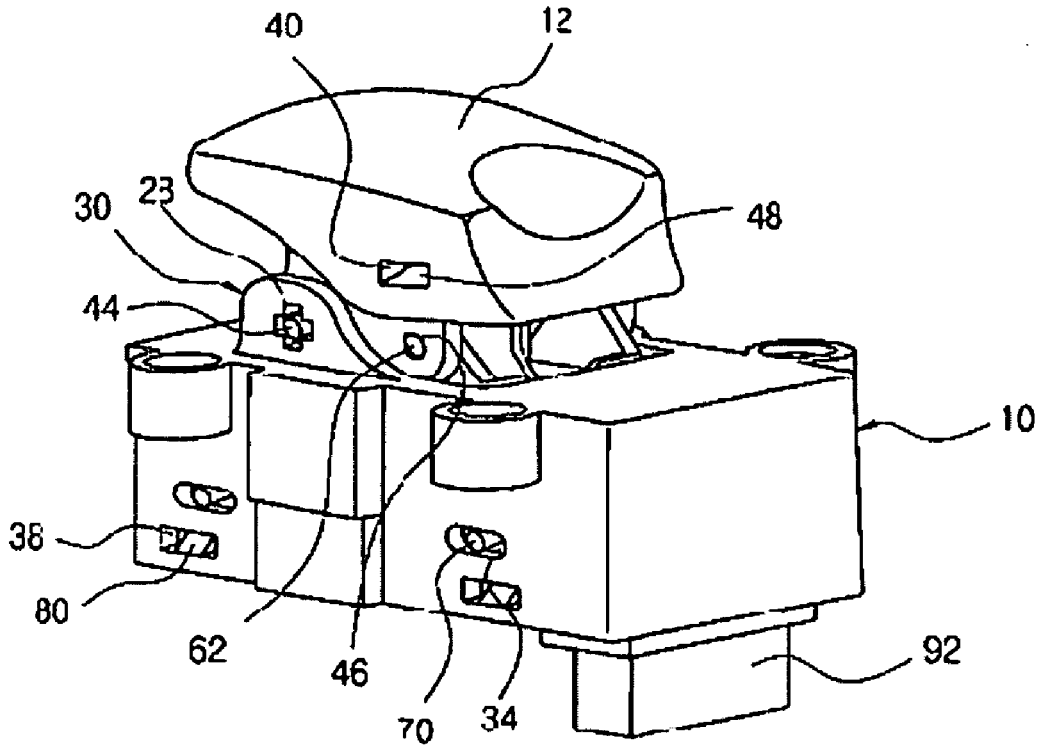
FIG. 4A and FIG. 4B are perspective views of a single button six-way sunroof switch in accordance with the present invention, in which the switch is assembled completely.
Figure 4B:
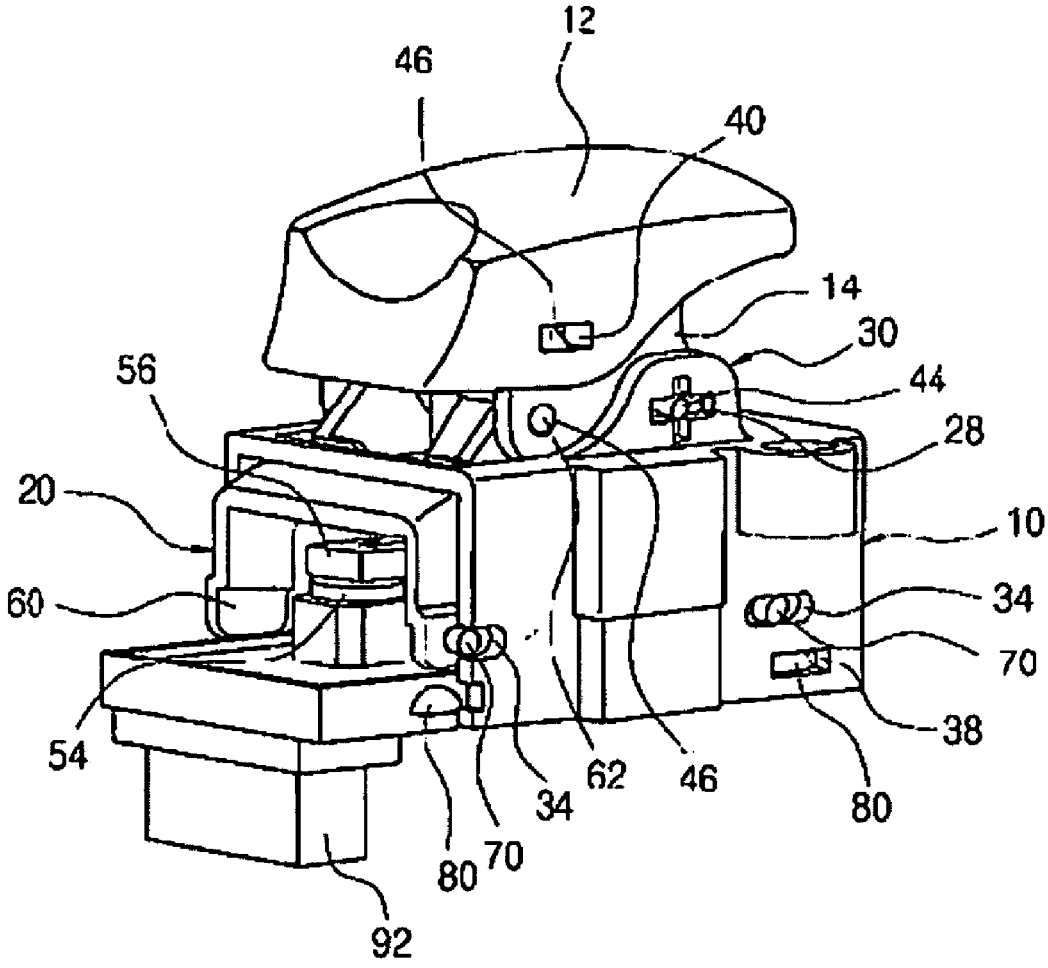

As illustrated in more detail in FIG. 4B, the slide pins 70 formed on the support legs 60 are engaged with the respective slide slots 34 of the case 10 to slide along the slide slot 34.

The contact 22 to be coupled with the lever 18 includes a body part 72 coupled to a lower part of the lever 18 and first and second contact-point legs 74 and 76 attached on the lower surface of the body part 72 and extending outwardly in four directions. The contact-point legs 74 and 76 are formed of a conductive material.

Referring to FIG. 2A and FIG. 2B, the body part 72 of the contact 22 has coupling holes 78 on both sides thereof to be coupled with respective coupling projections 52 of the lever 18.

The contact-point legs 22 outwardly extend in the oblique direction, where two of the contact-point legs 22 are first contact-point legs 74 for partial-open and partial-close operations of a sunroof and the other two are second contact-point legs 76 for full-open and full-close operations of a sunroof.

Next, the PCB 24 serving as the contact points and controlling on and off of a sunroof switch will be described below in detail.

Referring to FIG. 3A, on the upper surface of the PCB 24, the tact switches 54 to be selectively pushed by the push pads 56 of the lever 18 are separately arranged and further a plurality of contact points 86, 88 with which the contact-point legs 74, 76 of the contact 22 bring into contact are formed in the predetermined arrangement.

Here, the PCB 24 is mounted on the upper surface of the cover 36, and the cover 36 is coupled with the bottom of the case 10 for covering the lower opening of the case 10 after all the parts constituting the sunroof switch in accordance with the present invention are integrally assembled and received inside the case 10.

The case 10 and the cover 36 are coupled such that the coupling projections 80 formed on the outer surface of the cover 36 are engaged with the coupling grooves 38 formed on the side surfaces of the case 10 below the slide slots 34.

Figure 5:
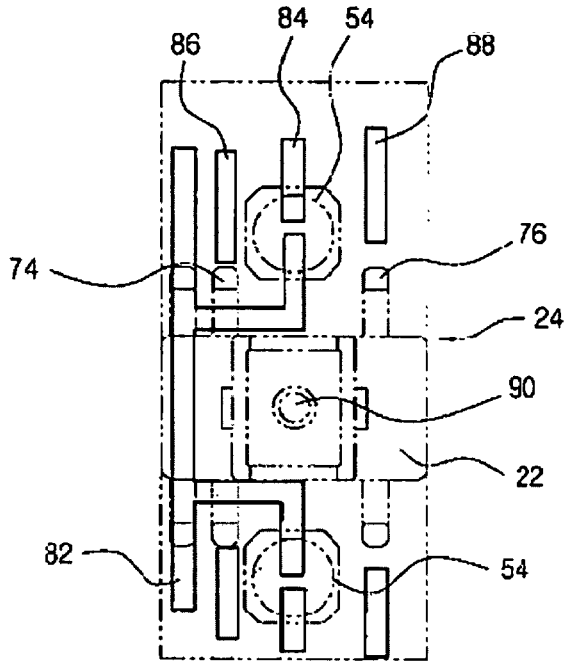
FIG. 5 is a plan view of a printed circuit board (PCB) for use in a single button six-way sunroof switch in accordance with the present invention.

Here, the description will be made with PCB 24 below in more detail. With reference to FIG. 5, on the upper surface of the PCB 24, a negative polarity terminal 82 is arranged at a side, tilt-up/tilt-down contact points 84 with which the tact switches 54 will be brought into contact are arranged in the middle portion, first step contact points 86 with which the first contact-point legs 74 will be brought into contact are arranged between the negative polarity terminal 82 and the tilt-up/tilt-down contact points 84, and second step contact points 88 are arranged at the opposite side of the negative polarity terminal 82.

Further, a light emitting diode (LED) 90 for emitting light is disposed at the center portion of the PCB 24.

FIG. 4A and FIG. 4B illustrate the sunroof switch in accordance with the present invention, in which all the parts are completely assembled. When the sunroof switch is installed on the ceiling of a vehicle, the case 10 and a connector 92 extending from the PCB 24 through the cover 36 are buried inside the ceiling of a body of the vehicle, and only the knob 12 is exposed so as to control the switch.

The operation of the sunroof switch in accordance with the present invention as described above will be explained below.

Referring to FIG. 6A, reference symbol "R" denotes a pivot point for the tilt operation of the knob where the hinge pin 62 is engaged with the hinge hole 46 of the knob base.

Reference symbol "TH" denotes a point that the guide pin 44 of the knob base 14 is inserted into the cross guide hole 28 of the guide 30 integrally formed with the case 10, where the guide pin 44 moves in the direction of up and down (direction T) in the cross guide hole 28 for the tilt-up and tilt-down operations of the knob 12, and the guide pin 44 moves in the direction of back and forth (direction H) in the cross guide hole 28 for opening and closing operations of the knob 12.

When operating the knob 12 in the direction of back and forth for opening and closing the sunroof, the slide pins 70 formed the on support legs 60 of the slider 20 move along the corresponding slide slots 34 formed in the case 10.

At this time, referring to FIG. 6B and FIG. 6C, in the status that the front end of the rod 66 is received in and supported by the holder 32 formed on the inner wall of the case 10, if the knob 12 is operated to move in the direction, back or forth, for opening and closing the sunroof, the slider 20 and the rod 66 move together back or forth along the holder 32. If the knob 12 is released, the rod 66 is retracted to the center portion, which is the default position of the rod 66, along the surface of the holder 32.

When the rod 66 is retracted to the center portion, the default position, along the surface of the holder 32, the slider 20, the knob base 14 linked with the slider 20, and the knob 12 combined with the knob base 14 are returned to their own default positions, respectively.

The operation steps and statuses of the sunroof switch in accordance with the present invention will be described below.

(1) Operation to Tilt Down a Sunroof

Figure 7:
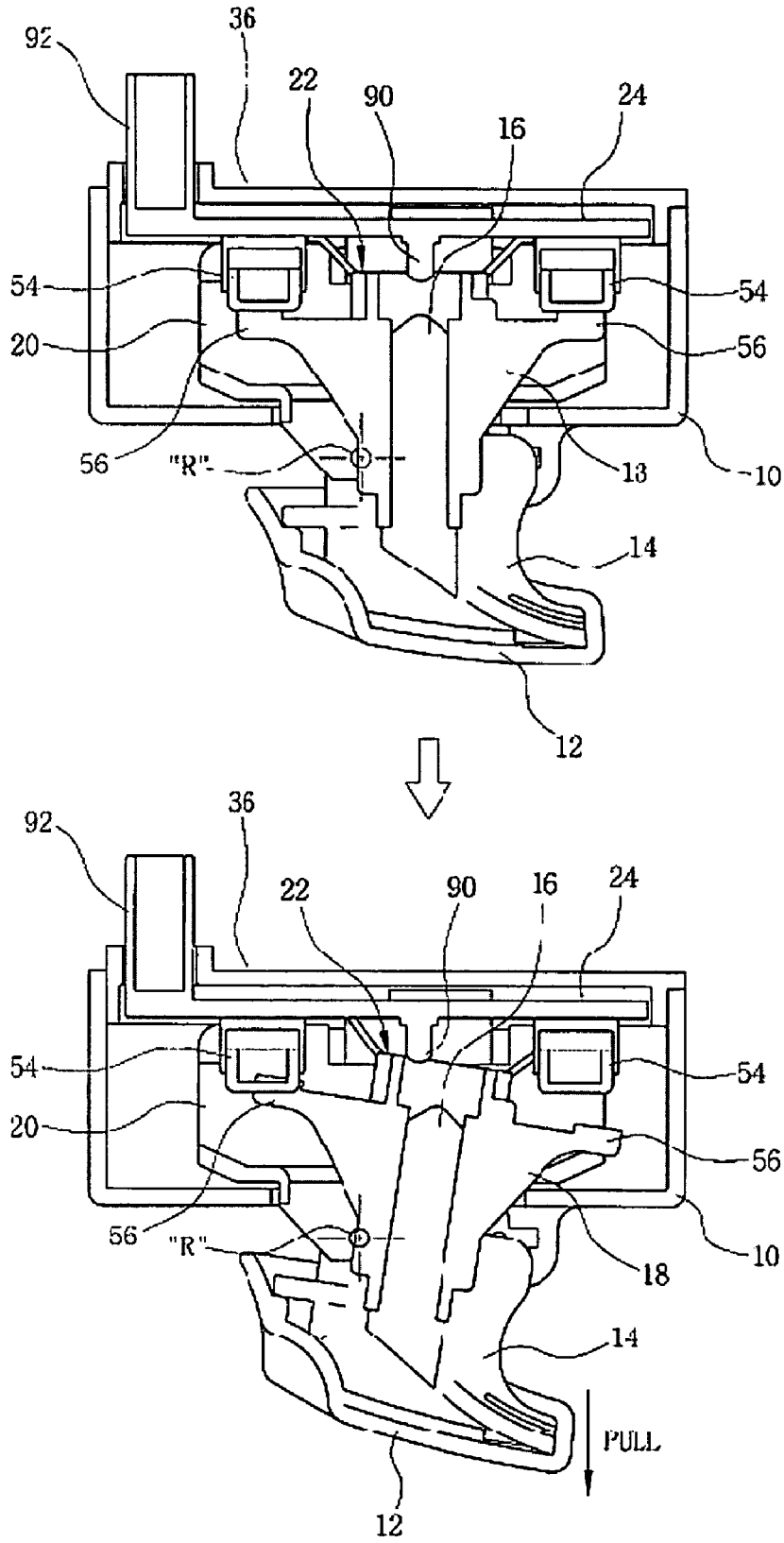
FIG. 7 is a partial cut-away view of a single button six-way sunroof switch in accordance with the present invention, in which the switch is in the tilt-down status.

Referring to FIG. 7, the tilt-down of the sunroof is achieved by pulling the knob 12. When the knob 12 is pulled, the knob base 14 angularly pivots on the pivot point "R" and the light emitting rod 16 fixed to the coupling hole 42 is simultaneously pulled, so that the lever 18 integrally formed at the lower part of the light emitting rod 16 is tilted in the direction that the knob 12 is pulled.

Accordingly, one push pad 56 (for tilt-up) of the lever 18 is separated from the tact switch 54 by the pivoting of the knob 12, and the other push pad 56 (for tilt-down) of the lever 18 comes into contact with the tact switch 54, so that the tilt-down operation of the sunroof is performed as soon as the contact point for tilt-down arranged on the PCB 24 is conducted.

(2) Operation to Tilt Up a Sunroof

Figure 8:
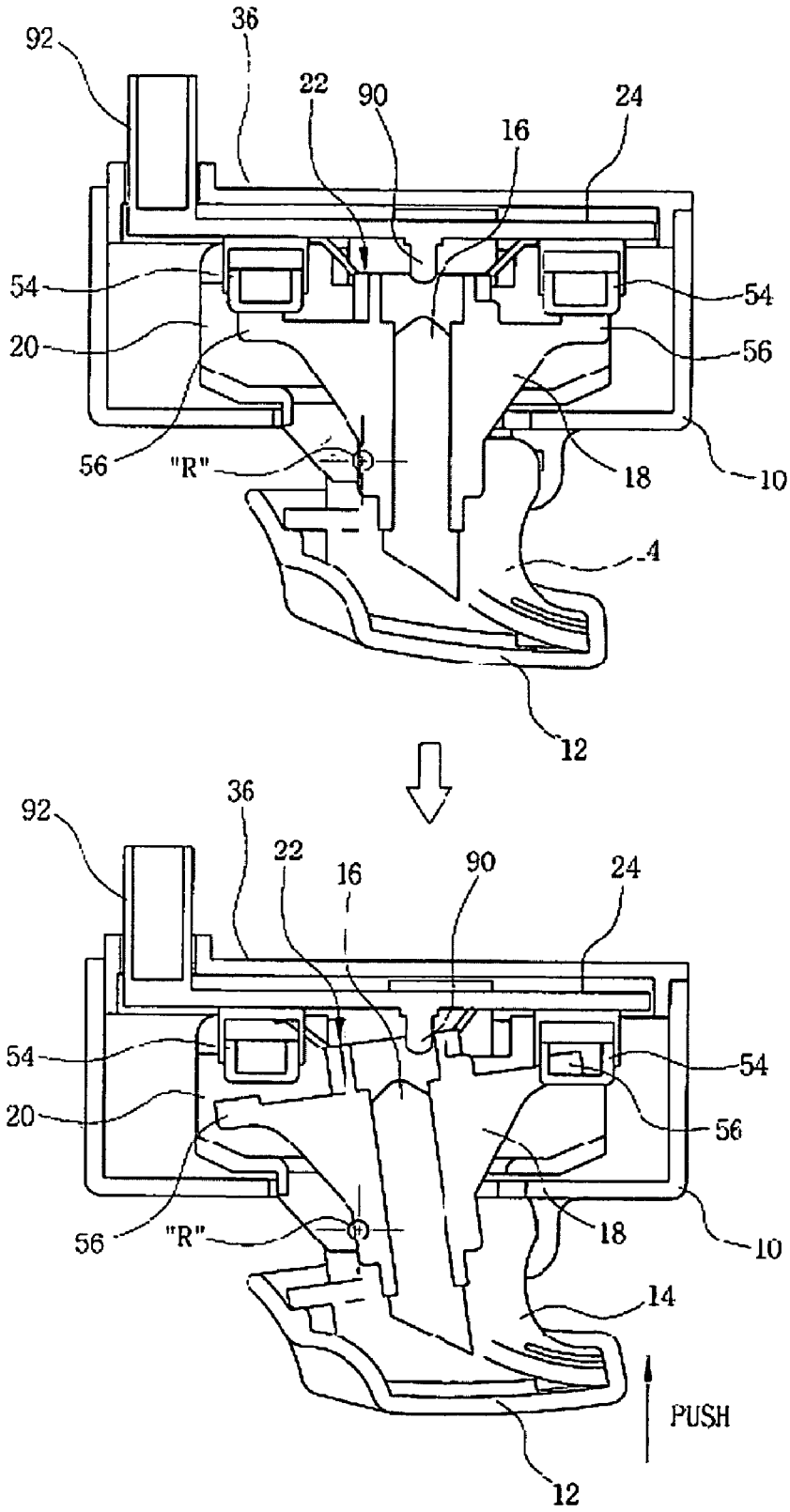
FIG. 8 is a partial cut-away view of a single button six-way sunroof switch in accordance with the present invention, in which the switch is in the tilt-up status.

Referring to FIG. 8, the tilt-up of the sunroof is achieved by pushing the knob 12. When the knob 12 is pushed, the knob base 14 angularly pivots on the pivot point "R" and the light emitting rod 16 fixed to the coupling hole 42 is simultaneously pulled, so that the lever 18 integrally formed at the lower part of the light emitting rod 16 is tilted in the opposite direction of the direction that the knob 12 is pulled.

Accordingly, one push pad 56 (for tilt-down) of the lever 18 is separated from the tact switch 54 by the pushing operation of the knob 12 like a seesaw motion, and the other push pad 56 (for tilt-up) of the lever 18 comes to push the tact switch 54, so that the tilt-up operation of the sunroof is performed as soon as the contact point for tilt-up arranged on the PCB 24 is conducted.

(3) Operation to Open a Sunroof

Figure 9:
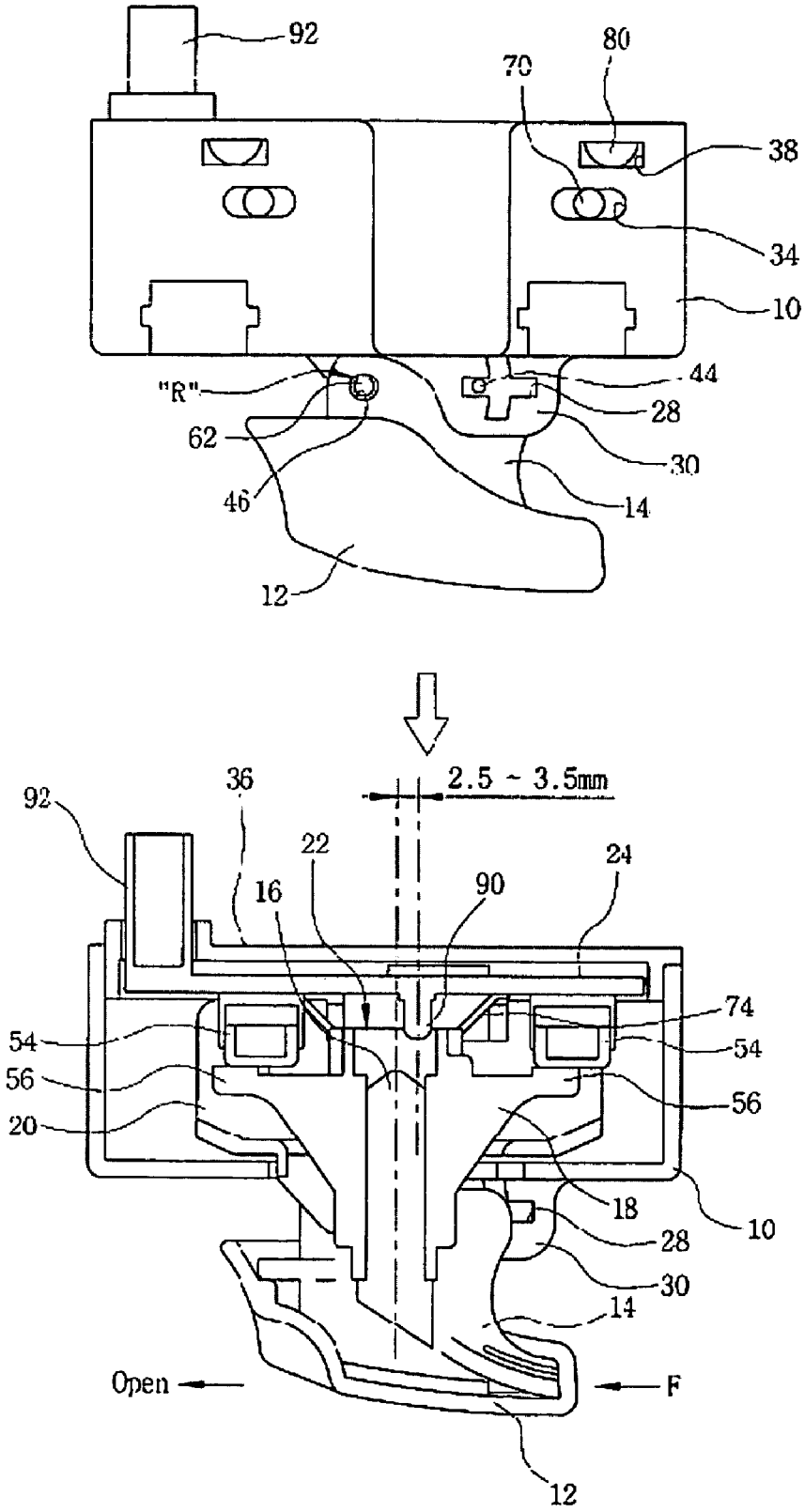
FIG. 9 is a partial cut-away view of a single button six-way sunroof switch in accordance with the present invention, in which the switch is in the open status.

With reference to FIG. 9, when the knob 12 is operated to the left to open the sunroof, the knob base 14 combined with the knob 12, the light emitting rod 16 combined with the knob base 14, the lever 18 integrally combined with the light emitting rod 16 at a lower part thereof, and the slider 20 combined with the lever 18 simultaneously move to the left.

Accordingly, the first contact-point legs 74 of the contact 22 reach the first step contact points 86 on the PCB 24, thereby making electrical contact. As a result, the sunroof is partially opened.

At this time, since the slide pins 70 formed on the support legs 60 move along the slide slots 34 formed in the case 10, the slide slots 34 guide and limit the movement of the slider 20. The length of the movement of the slider 20 is in the range of 2.5 to 3.5 mm.

That is, since the total length of the slide slot 34 formed in the case 10 is in the range of 5 to 7 mm, the slide pin 70 initially positioned in the middle of the slide slot 34 can move back and forth by about 2.5 to 3.5 mm.

Here, if the knob 12 is pulled farther to the left, the second contact-point legs 76 of the contact 22 reach the second step contact points 88 on the PCB 24, thereby being conducted. As a result, the sunroof is fully opened.

(4) Operation to Close a Sunroof

Figure 10:
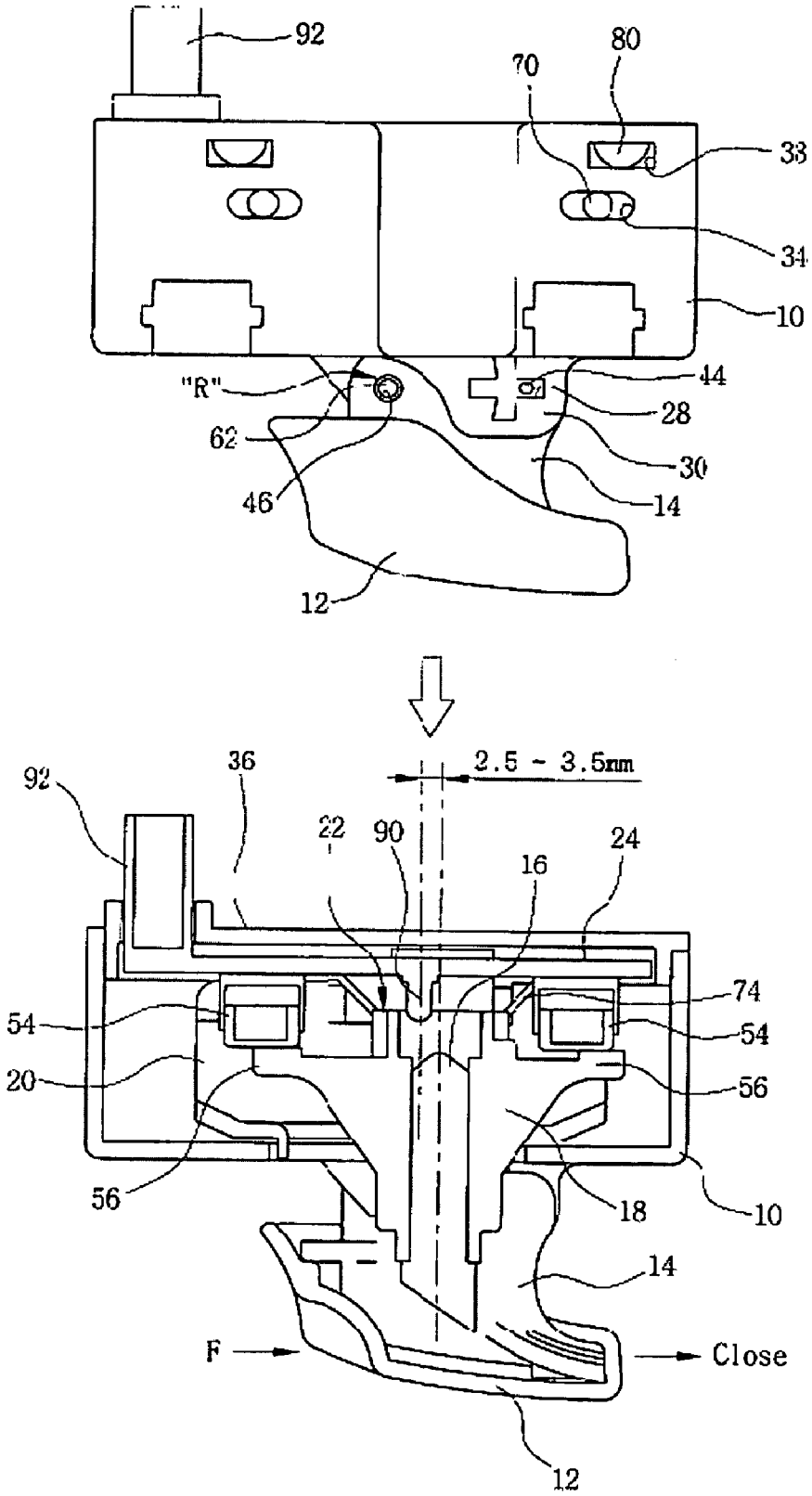
FIG. 10 is a partial cut-away view of a single button six-way sunroof switch in accordance with the present invention, in which the switch is in the close status.

Referring to FIG. 10, when the knob 12 is operated to the right to close the sunroof, the knob base 14 combined with the knob 12, the light emitting rod 16 combined with the knob base 14, the lever 18 integrally combined with the light emitting rod 16 at a lower part thereof, and the slider 20 combined with the lover 18 simultaneously move to the right.

Accordingly, the first contact-point legs of the contact 22 reach the first step contact points 86 on the PCB 24, thereby making electrical contact. As a result, the sunroof becomes partially closed.

In a similar manner to the opening operation of the sunroof, as described above, since the slide pins 70 formed on the support legs 60 of the slider 20 move along the slide slots 34 formed in the case 10, the slide slots 34 guide and limit the movement of the slider 20. The movement length of the slider 20 is in the range of 2.5 to 3.5 mm.

Here, if the knob 12 is pushed farther to the right, the second contact-point legs 76 of the contact 22 reach the second step contact points 88 on the PCB 24, thereby being conducted. As a result, the sunroof is fully closed.

Meanwhile, since light emitted from the LED 90 mounted on the PCB 24 reaches the knob 12 via the light emitting rod 16, the engraved radiation mark is illuminated. Accordingly, visibility of knob operation is enhanced.

In accordance with the present invention, as described above, opening and closing of the sunroof can be controlled in six ways (full-open, full-close, tilt-up, tilt-down, partial-open and partial-close) using a single button, thereby permitting a driver to freely control degree of opening of the sunroof as he/she desires.

The present invention provides a sunroof switch with simple structure and excellent, smooth and precision opening-closing maneuverability compared to conventionally sunroof switches. The sunroof switch in accordance with the present invention can reduce manufacturing cost and enhance assembly work efficiency due to its simple structure.

Those skilled in the art will appreciate that the conceptions and specific embodiments disclosed in the foregoing description may be readily utilized as a basis for modifying or designing other embodiments for carrying out the same purposes of the present invention.

What is claimed is:

1. A single button six-way sunroof switch, comprising:

a knob base having a coupling hole penetrated vertically, two side surfaces, each having a projected hook, and a hinge hole at a lower end portion;

a knob with two side surfaces, each having a coupling groove, wherein the hooks of the knob base are engaged with the coupling grooves;

a light emitting rod having a latching jaw at an upper end portion thereof wherein the latching jaw is latched with an upper end of the knob base at a perimeter of the coupling hole;

a lever integrally formed with the light emitting rod at two sides and a lower end of the light emitting rod;

a slider having a panel with four corners, said panel having a through-hole penetrated vertically and formed at a center portion of the panel, a support leg extended from each of said four corners and integrally formed with the panel, and a hinge pin formed on an upper end portion of the panel;

a contact having a body part coupled to a lower end portion of the lever which passes through the through-hole of the slider, and two contact-point legs attached to the body part and extending outward therefrom in four directions;

a PCB having an upper surface on which a plurality of tact switches to be pushed by the lever are arranged and a plurality of contact points with which the contact-point legs are brought into contact;

a case having a hollowed inner space, a first opening at an upper end, and a second opening at a lower end; wherein the knob base, the light-emitting rod, the lever, the slider, the contact, and the PCB are disposed within the hollowed inner space; and a cover for covering the second opening of the case.

2. The sunroof switch according to claim 1, wherein the case further has a guide on each of two sides of the upper end and each of said guides has a cross guide hole.

3. The sunroof switch according to claim 2, wherein a guide pin to be engaged with one of said cross guide holes projects from each side surface of the knob base.

4. The sunroof switch according to claim 1, wherein the case further has a holder shaped with a right angle on each of two side surfaces of the hollowed inner space.

5. The sunroof switch according to claim 4, wherein the slider further has support grooves on each of two sides thereof, wherein a spring and a rod are inserted into and supported by each support groove, and a front end of each rod is received and supported by a respective one of the holders by an elastic force of a respective one of the springs.

6. The sunroof switch according to claim 1, wherein the case further has a slide slot at a lower portion of each of two sides of the case, which limits movement of the slider.

7. The sunroof switch according to claim 6, wherein a slide pin inserted into each slide slot is integrally formed with each contact-point leg by being projected on an outer surface of each contact-point leg.

8. The sunroof switch according to claim 1, wherein coupling projections are integrally formed with the lever, each of which is projected from one of two sides of the lever in a middle portion of a lower part thereof, and the body part of the contact has a coupling hole on each of two side surfaces, with which a respective one of the coupling projections is engaged.

9. The sunroof switch according to claim 1, wherein a lower part of the lever has two sides that extend to reach the tact switches and have push pads on bottoms thereof for pushing the tact switches.

10. The sunroof switch according to claim 1, wherein two of the contact-point legs are first contact-point legs provided for partial-open and partial-close operations of the sunroof, and two of the contact-point legs are second contact-point legs provided for full-open and full-close operations of the sunroof.

11. The sunroof switch according to claim 10, wherein a negative polarity terminal is arranged on a first side of the upper surface of the PCB, tilt-up/tilt-down contact points with which the tact switches will be brought into contact are arranged in a middle portion of the upper surface of the PCB, first step contact points are arranged on the upper surface of the PCB between the negative polarity terminal and the tilt-up/tilt-down contact points where the first contact-point legs among the contact-point legs reach the first step contact points, and second step contact points are arranged at a second side of the upper surface of the PCB.

12. The sunroof switch according to claim 11, wherein an LED is mounted on the middle portion of the upper surface of the PCB.

* * * * *